US008573504B1

(12) United States Patent
Lee et al.

(10) Patent No.: US 8,573,504 B1
(45) Date of Patent: Nov. 5, 2013

(54) FURNACE

(75) Inventors: Davis Lee, Union Grove, AL (US); Dale Carroll, Albertville, AL (US); Chris Pankey, Guntersville, AL (US); James Richard Bullington, Athens, AL (US); Adam Lee Walker, Albertville, AL (US); Steven Michael Birchfield, Geraldine, AL (US); Billy Erskin Hosmer, Crossville, AL (US); Stephen Wayne Bennett, Madison, AL (US); Amanda Lauren Conger, Huntsville, AL (US)

(73) Assignee: Lee Energy Solutions, Guntersville, AL (US)

( * ) Notice: Subject to any disclaimer, the term of this patent is extended or adjusted under 35 U.S.C. 154(b) by 1106 days.

(21) Appl. No.: 12/583,495

(22) Filed: Aug. 21, 2009

(51) Int. Cl.
*F24H 9/20* (2006.01)
*F23N 5/00* (2006.01)
*F23K 3/00* (2006.01)

(52) U.S. Cl.
USPC ..... 236/11; 236/15 BA; 236/15 BC; 236/15 BD; 110/190; 110/288

(58) Field of Classification Search
USPC ..... 236/11, 15 BA, 15 BC, 15 BD; 110/105, 110/186, 190, 267, 286, 288; 431/12; 126/501
See application file for complete search history.

(56) References Cited

U.S. PATENT DOCUMENTS 4,312,278 A 1/1982 Smith et al.
4,342,359 A 8/1982 Baker
4,520,790 A 6/1985 Sagness et al.
4,619,209 A 10/1986 Traeger et al.
4,842,190 A 6/1989 Orchard
4,881,472 A 11/1989 Stromberger et al.
5,133,266 A 7/1992 Cullen
5,243,963 A 9/1993 Riener
5,331,943 A 7/1994 Ko
5,680,822 A 10/1997 Hallberg
5,944,090 A 8/1999 Teal
5,983,890 A 11/1999 Thomas et al.
6,223,737 B1 5/2001 Buckner
6,334,483 B1 1/2002 Berglund et al.
7,870,854 B2 * 1/2011 Lau et al. ..... 126/73

(Continued)

FOREIGN PATENT DOCUMENTS

JP 2005121337 A 5/2005

*Primary Examiner* — Marc Norman
(74) *Attorney, Agent, or Firm* — C. Brandon Browning; Maynard, Cooper & Gale, PC

(57) ABSTRACT

A furnace for burning solid burning biomass fuels such a municipal waste and wood pellets including a first compartment containing a hopper, a motorized auger positioned in the bottom of the auger for conveying a solid fuel out of the hopper, a first blower tube operatively coupled to the hopper for receiving the solid fuel from the hopper and a first blower operatively coupled to the blower tube for blowing the fuel through first blower tube. In a second compartment, the furnace contains a combustion chamber operatively coupled to the blower tube opposite the first blower and a heat exchanger arranged above the combustion chamber. To cool the heat exchanger, a second blower is operatively coupled to the heat exchanger for blowing a cooling air through the heat exchanger. A programmable control system is operatively coupled to the auger, the first blower, the second blower and a plurality of thermocouples for controlling the operation of the furnace.

23 Claims, 10 Drawing Sheets

(56) References Cited

U.S. PATENT DOCUMENTS

| | | | | |
|---|---|---|---|---|
| 2002/0083944 | A1 | 7/2002 | Darbonne, Sr. | |
| 2007/0125281 | A1 | 6/2007 | Ingvarsson | |
| 2007/0137537 | A1 | 6/2007 | Drisdelle et al. | |
| 2007/0157858 | A1 | 7/2007 | Gagner et al. | |
| 2008/0110380 | A1 | 5/2008 | Gauthier et al. | |
| 2008/0156312 | A1 | 7/2008 | Graham et al. | |
| 2009/0013985 | A1 * | 1/2009 | Little et al. | 126/67 |
| 2010/0251973 | A1 * | 10/2010 | Dongo et al. | 122/14.1 |

* cited by examiner

| | |
|---|---|
| TC2 Cool-down | 70.0 |
| TC2 Standby | 175.0 |
| TC2 CtrlRng Mn | 310.0 |
| TC2 CtrlRng Mx | 325.0 |
| TC2 Overheated | 350.0 |

FIG. 9

| | |
|---|---|
| Init Comb Cycs | 10 |
| Init Comb On | 10.0 |
| Init Comb Off | 20.0 |
| No Fire (min) | 15 |

FIG. 10

| | |
|---|---|
| S-by Auger On | 35.0 |
| S-by Auger Off | 25.0 |
| Warm Auger On | 20.0 |
| Warm Auger Off | 40.0 |

FIG. 11

| | |
|---|---|
| Ramp Auger On | 55.0 |
| Ramp Auger Off | 5.0 |
| Ctrl Auger On | 50.0 |
| Ctrl Auger Off | 10.0 |

FIG. 12

| | |
|---|---|
| Over Auger On | 5.0 |
| Over Auger Off | 55.0 |
| TC1 Range Low | 70.0 |
| TC1 Range High | 130.0 |
| Min Duct (sec) | 120.0 |

FIG. 13

FURNACE

FIELD OF THE INVENTION

The present invention relates to an apparatus and method for generating heat by combusting biomass fuels, and more particularly to a furnace that can be operated over an extended period of time to produce a controlled heat output from particulate solid fuel, exemplified by wood waste pellets and wood chips.

BACKGROUND OF THE INVENTION

The use of solid pellets as a fuel source is known, particularly in the art of furnaces and the like. Such furnaces include a combustion space containing a combustion chamber, a transport device for the solid fuel pellets and a hopper. A convection space is provided for circulating air by means of a blower for cooling the combustion space and a flue gas blower for driving combustion of the fuel pellets. The control procedures during operation of these furnaces, required by the devices for fuel and fresh air feed due to the changing operating conditions, take place by continuous monitoring of these furnaces and automatic intervention for purposes of regulation. With this, unsupervised operation of these furnaces is possible in many cases, but the energy utilization and the operational reliability are not satisfactory.

SUMMARY OF THE INVENTION

The present invention is directed to a furnace for burning solid burning biomass fuels such a municipal waste and wood pellets. The furnace can be used to heat structures such as chicken houses, homes, warehouses and the like. According to one aspect of the invention, the furnace includes a first compartment containing a hopper, a motorized auger positioned in the bottom of the hopper for conveying a solid fuel out of the hopper, a first blower tube operatively coupled to the hopper for receiving the solid fuel from the hopper and a first blower operatively coupled to the blower tube for blowing the fuel through first blower tube. In a second compartment, the furnace contains a combustion chamber operatively coupled to the blower tube opposite the first blower and a heat exchanger arranged above the combustion chamber. To cool the heat exchanger, a second blower is operatively coupled to the heat exchanger for blowing a cooling air through the heat exchanger. A programmable control system is operatively coupled to the auger, the first blower, the second blower and a plurality of thermocouples for controlling the operation of the furnace. Preferably, a first thermocouple is arranged about an upper portion of an output side of the heat exchanger for obtaining a first temperature, a second thermocouple is arranged about a lower portion of an output side of the heat exchanger for obtaining a second temperature and a third thermocouple is arranged within the cooling air prior to it entering the first chamber for obtaining a third temperature.

The programmable control system includes a plurality of predetermined second temperature set points and second temperature set point adjustment instructions for establishing a plurality of adjusted second temperature set points based upon the third temperature of the cooling air before it enters the first chamber. Based upon the plurality of adjusted second temperature set points and the second temperature, the programmable control system relies on a plurality of auger control instructions for activating and inactivating the auger and controlling the heat output of the furnace.

According to another aspect of the invention, there is provided a method for producing a controlled heat output. The method includes the steps of supplying a solid fuel to a first blower tube, blowing the solid fuel and a combustion air through the first blower tube and into a combustion chamber, combusting the fuel in the combustion chamber thereby heating the combustion air, passing the combustion air from the combustion chamber into a combustion air cooling channel of a heat exchanger and pre-heating a cooling air prior to blowing the cooling air through the heat exchanger thereby cooling the combustion air within the heat exchanger. In order to efficiently control the heat output, a second temperature about a lower temperature portion of the heat exchanger and a third temperature of the cooling air prior to being preheated within the first chamber is recorded and an operational mode for the furnace and a predetermined second temperature set point associated with the operational mode are established. Relying upon the third temperature and the predetermined second temperature set point, an adjusted second temperature set point is established. Thereafter, based upon a set of predetermined auger control instructions associated with the operational mode, the adjusted second temperature set point and the second temperature, the supply rate of the solid fuel to the first blower tube is modified as desired.

According to yet another aspect of the invention, there is provided a method for manufacturing a controlled heat output furnace. The method includes the steps of constructing an enclosure having a first compartment separated from a second compartment by an interior wall and providing a combustion air, solid fuel feed tube extending through the interior wall and between the first compartment and the second compartment. The method further includes operatively coupling a first blower and a first input end of the combustion air, solid fuel feed tube, operatively coupling a hopper and the combustion air, solid fuel feed tube and operatively coupling a fuel conveyor member and the hopper. A combustion box is supported within the second compartment and operatively coupled to a first output end of the combustion air, solid fuel feed tube to the combustion box. A heat exchanger is supported above the combustion and operatively coupled thereto. To cool the heat exchanger, a second blower tube is extended within the first compartment and a second output end of the tube is positioned to open into the second compartment. A second blower is coupled to a second input end of the second blower tube.

To efficiently control the heat output of the furnace, a programmable control system is coupled to the first blower, the second blower and the fuel conveyor member, as well a second thermocouple arranged about a lower portion of an output side of the heat exchanger for obtaining a second temperature and a third thermocouple arranged outside of the second compartment for obtaining a second temperature. The programmable control system is programmed to include several operational modes for the furnace and several predetermined second temperature set points, each of which is associated with a particular operational mode. Preferably, the operation modes includes a cool down mode, a standby mode, a control range minimum mode, a control range maximum mode and an overheated mode The programmable control system is programmed to calculate an adjusted second temperature set point for each operational mode based upon the third temperature and the predetermined second temperature set point for each such mode. Based upon the adjusted second temperature set point and the second temperature, a set of predetermined auger and blower control instructions that are associated with the operational modes are pre-programmed into the control system to control and modify the solid fuel supply rate from the hopper to the combustion air, fuel feed tube and the air flow rates to the combustion box and the second compartment.

BRIEF DESCRIPTION OF THE DRAWINGS

FIG. 9 displays an operational mode set points screen for a programmable control system for the furnace of FIG. 1.

FIG. 10 displays a combustion blower set points screen for the programmable control system of FIG. 11.

FIG. 11 displays a standby auger set point screen for the programmable control system of FIG. 1.

FIG. 12 displays a ramp and control auger set point screen for the programmable control system of FIG. 1.

FIG. 13 displays an over temperature auger and duct blower set point screen for the programmable control system of FIG. 1.

DETAILED DESCRIPTION OF PRESENTLY PREFERRED EMBODIMENTS

Figure 1:
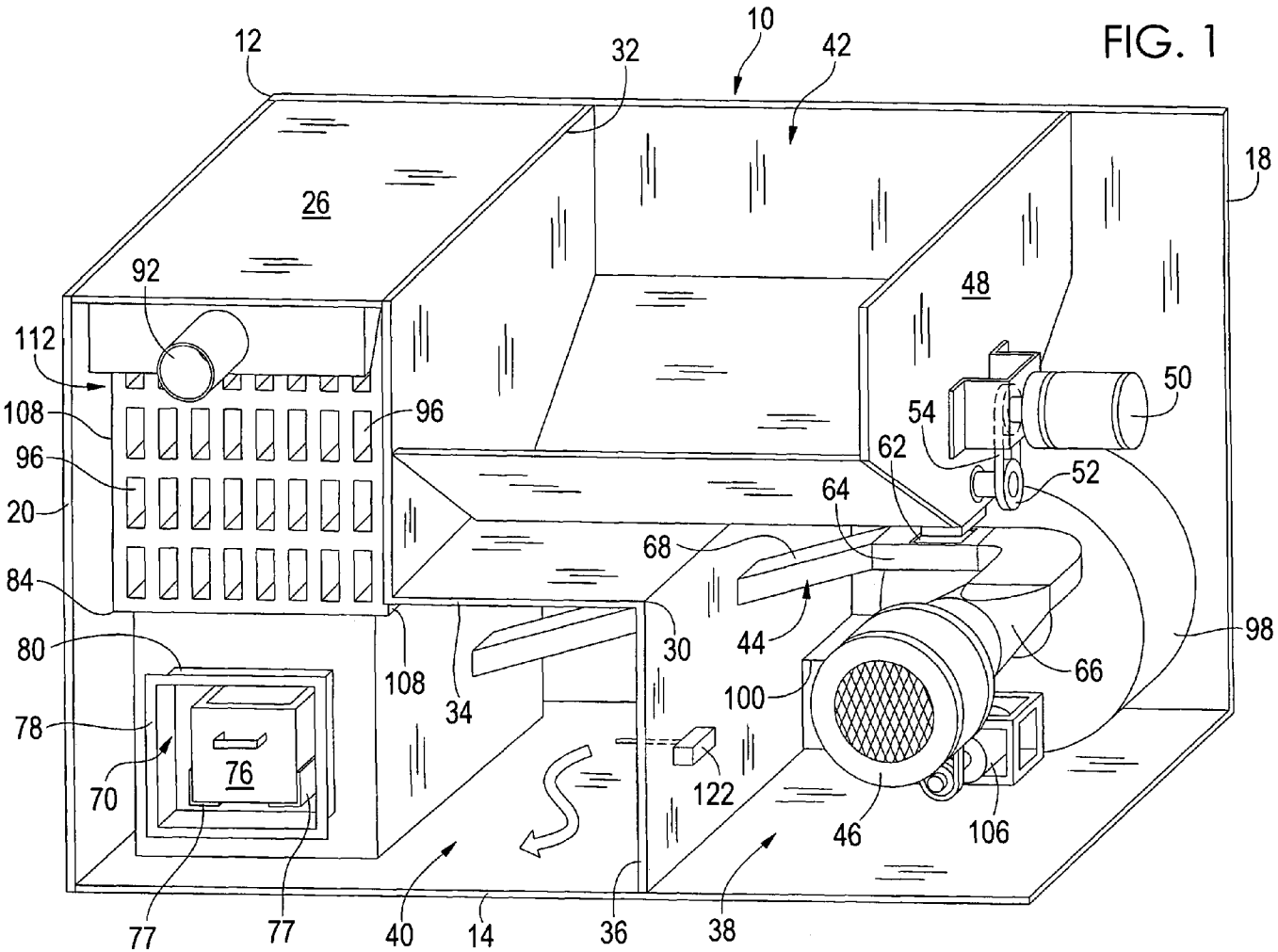
FIG. 1 is a perspective view of a wood pellet burning furnace in accordance with a preferred embodiment of the present invention.
Figure 2:
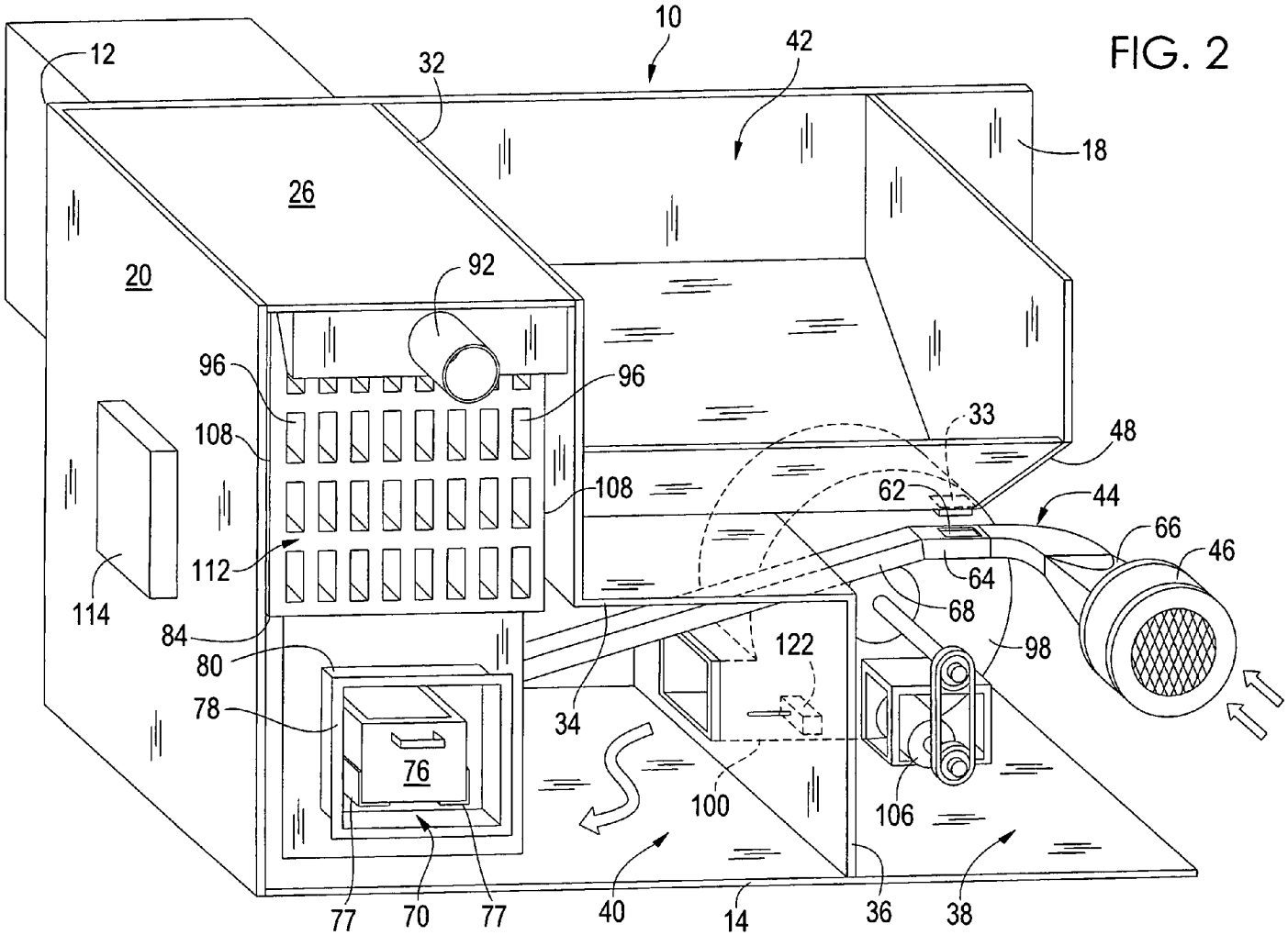
FIG. 2 is a further perspective view of the furnace of FIG. 1.
Figure 3:
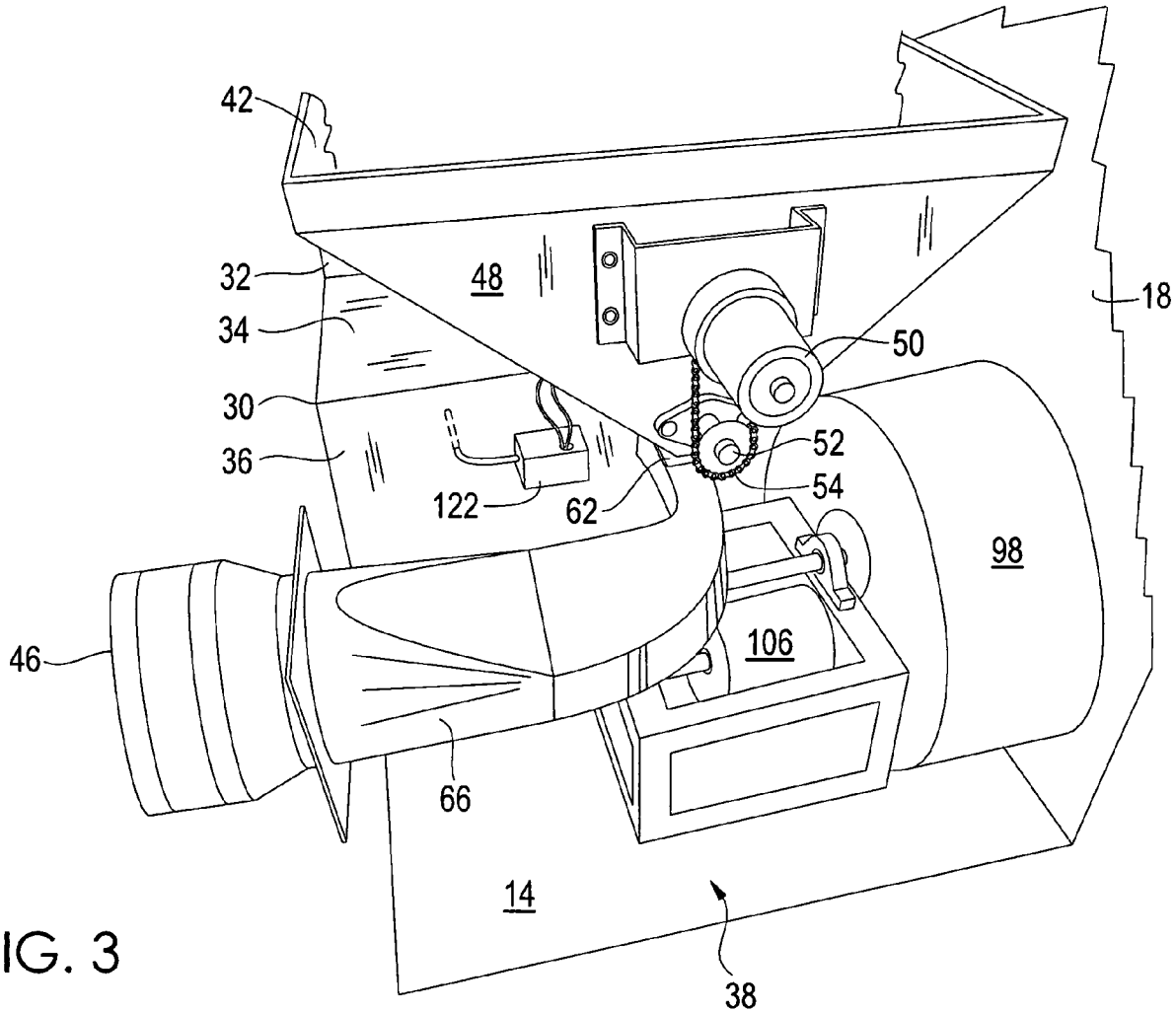
FIG. 3 is an elevational view of a lateral side of the furnace of FIG. 1 with a side panel removed.

FIGS. 1 through 13 display a wood pellet burning furnace 10 in accordance with a preferred embodiment of the present invention. Referring to FIGS. 1-3, furnace 10 generally includes an enclosure 12 for housing and supporting a combustion air and solid fuel feed system, a heat exchanger system, a combustion system and a control system. Enclosure 12 is made up of a rectangular floor panel 14 having four upstanding panels supported thereon to form a rectangular housing. The upstanding panels include a first lateral panel 16 through which access to the combustion system is made, a second lateral panel 18 through which air from the heat exchanger system exits into an area to be heated, a front panel 20 on which the control system is supported and a back panel 24. In combination with a top panel 26 for covering the heat exchanger system and a hopper lid 28, the first lateral panel and panels 14, 18, 20 and 24 form the exterior surfaces of furnace 10.

An interior panel 30 extends between the first and second lateral walls and floor panel 14 and top panel 26. In particular, interior panel 30 includes a first vertical wall portion 32 coupled at its lower edge to a front edge of a horizontal wall portion 34 that is coupled at its back edge to an upper edge of a second vertical wall portion 36. First vertical wall portion 32 is coupled at its upper edge to top panel 26 while second vertical wall portion 36 is coupled to floor panel 14 along its lower edge. Interior panel 30 operates to effectively divide enclosure 12 into two separate chambers including a first chamber 38 and a second chamber 40. First chamber 38 is generally used to house and support the combustion air and solid fuel feed system, and second chamber 40 is used to house and support the heat exchanger system and the combustion system.

Figure 4:
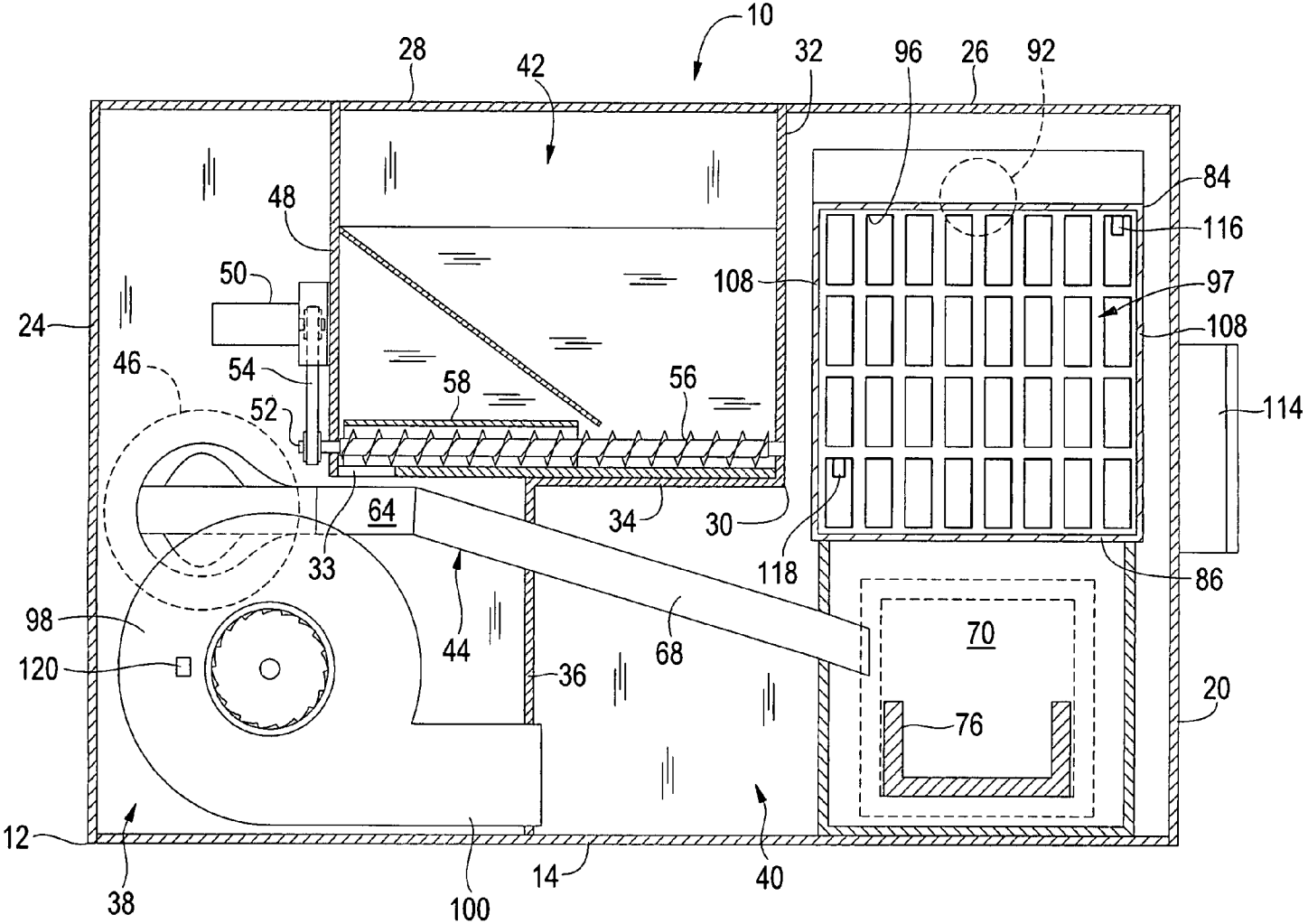
FIG. 4 is an elevational view of a back side of the furnace of FIG. 1 with a back panel removed.
Figure 5:
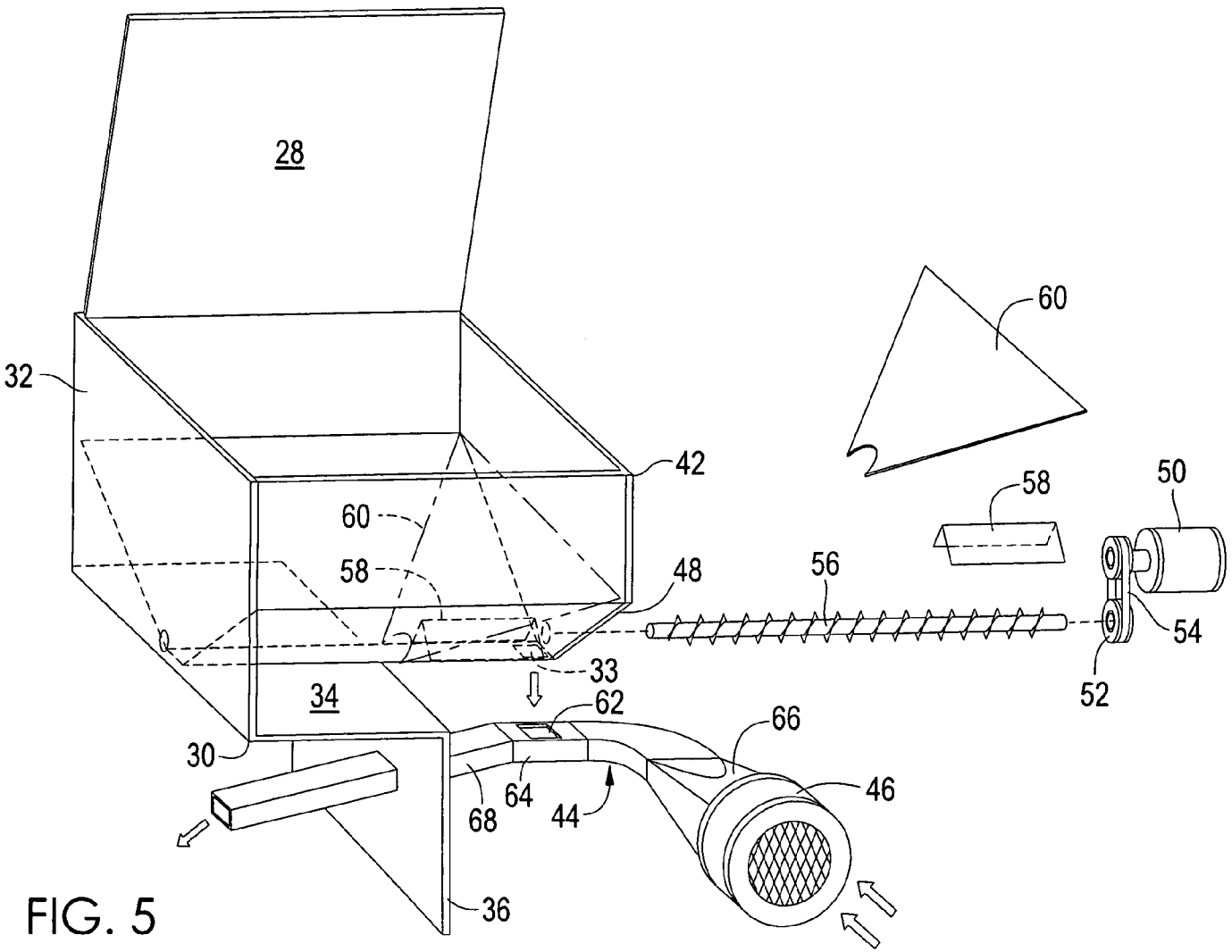
FIG. 5 is an exploded view of a combustion air and solid fuel feed system of the furnace of FIG. 1
Figure 6:
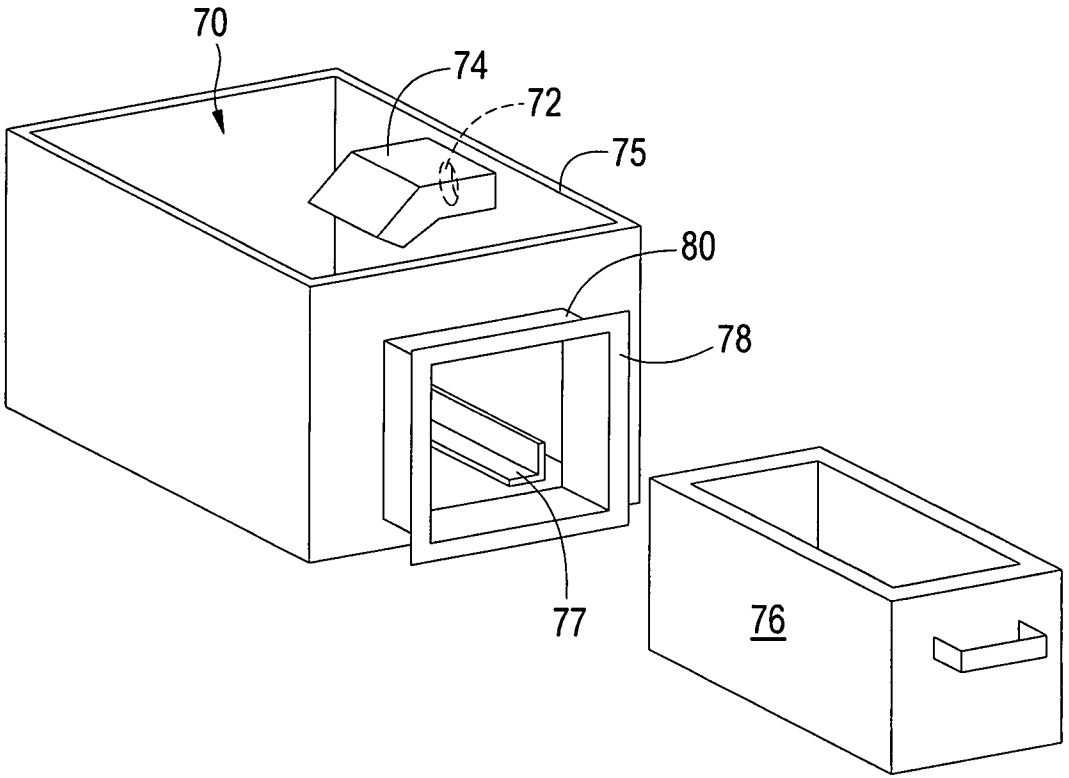
FIG. 6 is an exploded perspective view of a combustion chamber and a fire box of the furnace of FIG. 1.

Referring to FIGS. 3-5, the combustion air and solid fuel feed system housed in first chamber 38 includes a hopper 42 for storing the wood pellets, a blower fan tube 44 for receiving the pellets from hopper 42 and a single speed blower fan 46 for blowing the pellets through blower fan tube 44 into the combustion system. More particularly, hopper 42 is supported within first chamber 38 on horizontal wall portion 34 of interior panel 30 with first vertical wall portion 32 forming a front wall portion of hopper 42. Opposite the front wall portion is a V-shaped back wall portion 48 which provides hopper 42 a V-shaped cross-section. The preferred hopper capacity is 400 lbs though up to 600 lbs can be contained within hopper 42 by utilizing an extension that extends upwardly from the upper edges of the open top of hopper 42. Hopper 42 is enclosed using hopper lid 28.

Secured to the exterior of back wall portion 48 is a single speed auger motor 50 operatively coupled to an auger sprocket 52 by a chain 54. Auger sprocket 52 ratio is set to provide a feed rate from auger 56 of 40 lbs per hour. As depicted in FIG. 5, auger 56 is disposed in the bottom of hopper 42 and operatively coupled to auger sprocket 52. Auger 56 is arranged to transport wood pellets away first vertical wall portion 32 toward an exit opening 33 formed through the bottom of hopper 42 adjacent to auger sprocket 52. To more effectively transport the wood pellets, hopper 42 includes a elongate member 58 having an inverted V-shaped cross-section disposed above auger 58 along a portion of the bottom of hopper 42 about the exit opening. Member 58 ensures that the amount of wood pellets deposited through the exit opening by auger 56 is constant and at the predetermined rate. A flat, triangle-shaped member 60 is disposed over elongate member 58 slanting downward from an upper portion of back wall portion 48 toward the bottom of hopper 42 to ensure that all of the wood pellets in hopper 42 are directed to the uncovered portion of auger 42 and ultimately burned.

Positioned directly below exit opening 33 at the bottom of hopper 42 is an entry opening 62 into blower fan tube 44. Thus, when activated, wood pellets stored within auger 42 are transported to exit opening 33 by auger 42 and deposited directly into tube 44 by gravity. Hence, the amount of wood pellets supplied to fan tube 44 from hopper 42 is dictated solely by the operation of the auger 42 and auger motor 50. Entry opening 62 is formed within a substantially horizontal, central portion 64 of tube 44. Blower fan 46 is coupled to a funnel-shaped portion 66 of the tube that bends before extending into central portion 64. Funnel shaped portion 66 opens through first lateral panel 16 so that blower fan 46 is located outside enclosure 12. Opposite funnel shaped portion 66 of fan tube 44 is an angled portion 68 that exits from interior panel 30 into second chamber 40 at a downward angle for transporting the wood pellets and combustion air into a combustion chamber 70 of the combustion system. Preferably, blower fan operates at 560 CFM.

Figure 7:
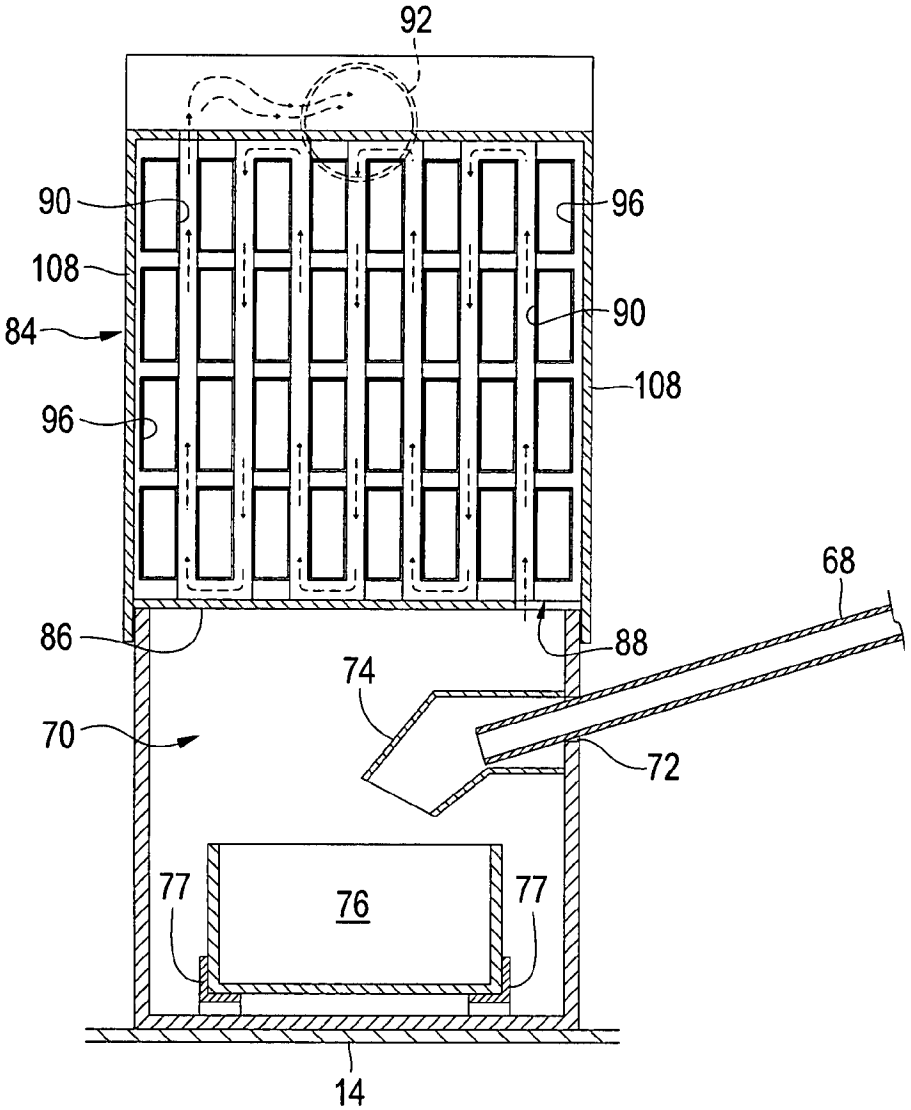
FIG. 7 is a sectional view of the combustion chamber and a heat exchanger of the furnace of FIG. 1

More particularly, referring to FIGS. 1, 4 and 7, angled portion 68 extends into combustion chamber 70 through a hole 72 in a sidewall of the chamber. Disposed about hole 72 in the interior of combustion chamber 70 is a spout member 74 arranged and angled downward for depositing the wood pellets to the center of combustion chamber 70 through the open top 75 thereof. By utilizing blower fan 46 to force the wood pellets into combustion chamber 70, the present invention overcomes the common problem of like furnaces of combustion gases blowing up a feed tube containing wood pellets towards a hopper and thereby igniting the wood pellets within the tube and hopper. Removably located within combustion chamber 70 is a combustion box 76 arranged to receive the wood pellets from spout member 74 and contain the pellets during combustion. Combustion box 76 is inserted into and removed from combustion chamber 70 through a side opening 78 in a neck 80 of the chamber that exits through a hole through the first lateral panel. Combustion box 76 is positioned within combustion chamber 70 by utilizing a pair of guide tracks 77 extending along the floor of the chamber and neck 80.

Supported directly on top of open top 75 of combustion chamber 70 is a heat exchanger 84 of the heat exchanger system. Referring to FIG. 7, heat exchanger 84 has a bottom plate 86 that extends to cover all of open top 75 of combustion chamber 70 with the exception of an elongated section 88 disposed adjacent to an upper edge of the sidewall of combustion chamber 70 through which angled portion 68 extends. Section 88 is aligned with a continuous, elongated cooling channel 90 that makes seven vertical passes through heat exchanger 84 before exiting through a vent 92 at the top of heat exchanger 92. As shown in FIG. 7, section 88 is provided above the spout. In this orientation, heat exchanger 84 is arranged to channel the combustion air flow toward front panel 20 before being vented. Alternatively, section 88 can be arranged adjacent to the output side of heat exchanger 84 so that the combustion air flow is toward a cooling air intake side thereof. Vent 92 exits through a hole in the first lateral panel. To cool the air flowing, through cooling channel 90, heat exchanger 84 is provided with thirty-two separate, horizontal channels 96 that are operatively connected to a single speed duct fan 98 and duct 100 for blowing ambient air into second chamber 40 and ultimately through horizontal channels 96. The air exiting horizontal channels 96 exits through an output side 97 of heat exchanger 84, through a first hole 102 in second lateral panel 18 and into the area to be heated by furnace 10.

Figure 8:
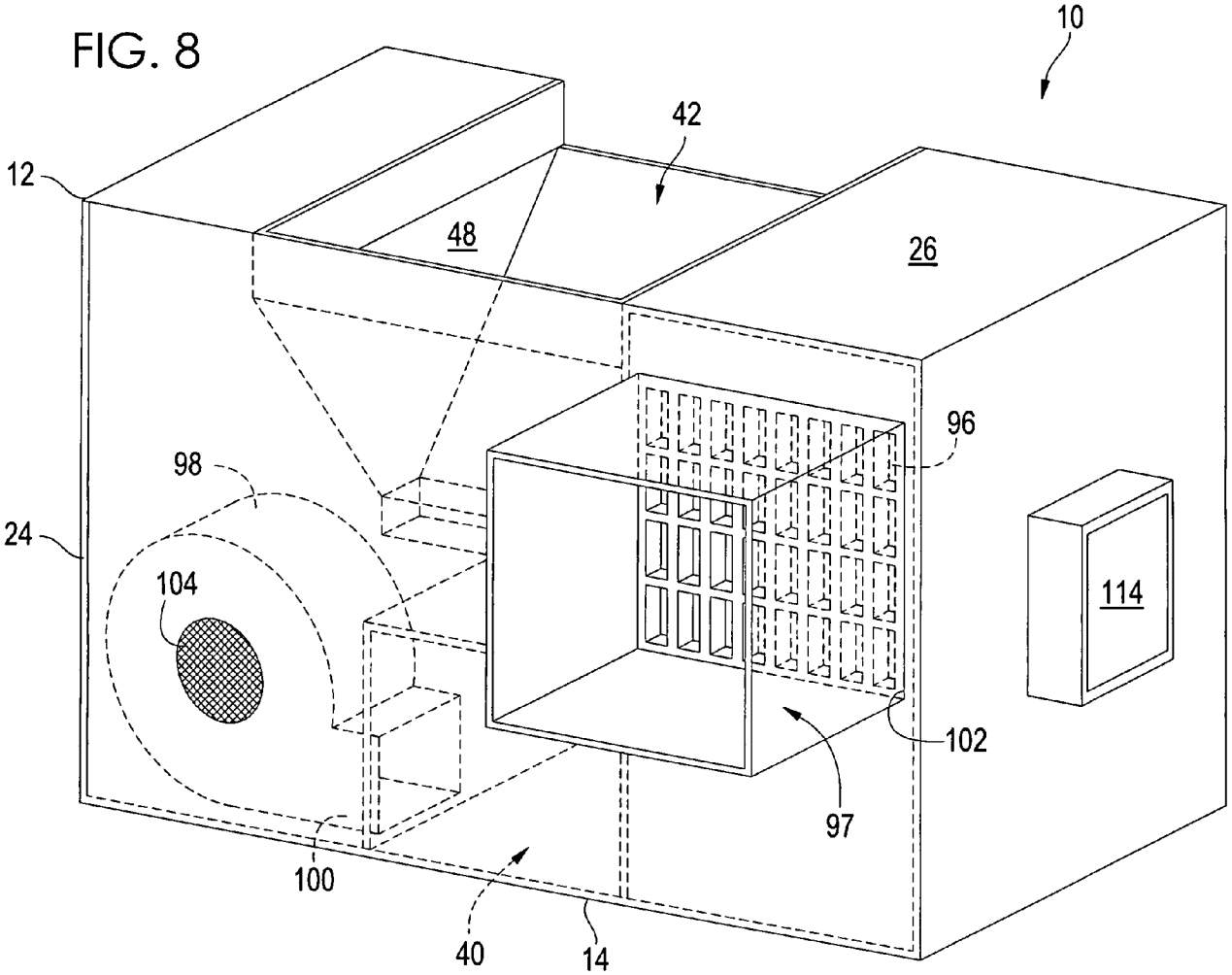
FIG. 8 is a perspective view of another lateral side of the furnace of FIG. 1 with a side panel removed.

More particularly, referring to FIGS. 3, 4 and 8, duct fan 102 is positioned within first chamber 38 below hopper 42. Duct fan 98 is arranged to pull ambient air into furnace 10 through a second hole 104 utilizing a duct fan motor 106 supported on floor panel 14 of enclosure 12. Duct fan 98 preferably produces an air flow rate of around 2,500 CFM. Air drawn by duct fan 98 is directed through duct 100 which deposits the air directly into second chamber 40. Combustion chamber 70 and heat exchanger 84 are arranged within second chamber 40 in a manner that allows the air deposited into second chamber 40 to circulate entirely around the sidewalls of combustion chamber 70 and the lateral sidewalls 108 of heat exchanger 84. As a result the ambient air directed into second chamber 38 is pre-heated before being directed into horizontal channels 96 of heat exchanger 84. The preheated air enters into a space on the intake side 112 of heat exchanger 84 defined between neck 80 of combustion chamber 70, first lateral side 16, front panel 20 and the side of combustion chamber 70 from which the neck extends. The air flow created by duct fan 98 forces the air through this space and into horizontal channels 96 thus cooling the air contained within cooling channel 90 and heating the air within horizontal channels 96 to a desired temperature of between 200° F. to 225° F.

To obtain the desired temperature of the air exiting heat exchanger 84 through horizontal channels 96 and ultimately the area to be heated, the operation of furnace 10 is controlled by a programmable control system. The system includes a programmable unit 114 having an interface, a processor and a storage capability. Unit 114 is programmed to operate within set but revisable parameters based upon temperatures and air pressures within or about furnace 10. In particular, programmable unit 114 is operatively coupled to a first thermocouple 116 fastened to the coolest point of heat exchanger 84 which is along a top edge of heat exchanger 84 on output side 97 opposite elongate section 88. First thermocouple 116 measures the temperature TC1 of the air exiting through horizontal channels 96 of heat exchanger 84 and transmits TC1 to unit 114. When programmable unit 114 receives a TC1 reading in excess of a predetermined amount, unit 114 switches off auger motor 50 thus stopping the flow of wood pellets to combustion chamber 70. A temperature greater than the predetermined amount is an indication that heat exchanger 84 has reached or exceeded its capacity and thus is overheating.

Programmable unit 114 is further operatively coupled to a second thermocouple 118 fastened to the warmest point of heat exchanger 84 on output side 97 thereof which is along a bottom edge of heat exchanger 84 near elongate section 88. Second thermocouple 118 measures the temperature TC2 of the air exiting through horizontal channels 96 of heat exchanger 84 and transmits TC2 to unit 114. TC2 is used by programmable unit 114 to control the operation and heat output of furnace 10 by activating and deactivating auger 56 via auger motor 50 and to a lesser extent blower fan 46 and duct fan 98. This is carried out by programming into unit 114, a number of TC2 set points which are associated with particular operational modes or sets of operational instructions for furnace. These set points represent temperatures at which a particular operational mode is commenced depending on the current TC2. Thus, when TC2 meets, is above or below a particular operational mode TC2 set point, a set of predetermined instructions are carried out by unit 114 in order to increase, maintain and decrease TC2 to the desired temperature. These instructions can include turning off duct fan 98 or increasing the ratio of auger 56 on time to off time when TC2 is too cool, for example, during start-up of furnace 10, or turning off auger 56 or decreasing the ratio of auger 56 on time to off time when TC2 is too hot. The TC2 set points depend on the operating environment of furnace 10 and are therefore subject to change.

Programmable unit 114 is also operatively coupled to a third thermocouple 120. Third thermocouple 120 can be located in any position that measures a temperature TC3 of air drawn into furnace 10 by duct fan 98, i.e., ambient air. Preferably, third thermocouple 120 is coupled to an intake side duct fan 98. TC3 is used by programmable unit 114 to calculate an adjusted TC2 set point for each of the operational modes. Such an adjustment is needed since TC3 of the ambient air can substantially affect the operation of furnace 10. A preferred adjustment calculation for each of the TC2 set points is:

$$TC2\ \text{Set point} + \frac{(TC3)(TC2\ \text{adjustment multiplier})}{TC2\ \text{adjustment divisor}} = \text{Adjusted } TC2 \text{ set point (Target Temp.)}.$$

where the TC2 adjustment multiplier and the TC2 adjustment divisor represent a desired fraction of TC3 when only a fraction of the adjustment represented by TC3 is required. Applying this process for controlling furnace 10 operations, furnace 10 can attain between 90% and 95% efficiency.

In the event duct fan 98 fails to activate when needed, there is the potential for heat exchanger 84 to quickly overheat. To prevent such an event, a second chamber or duct pressure gauge 122 operatively coupled to programmable unit 114 is mounted on horizontal wall portion 34 within first chamber 38 with a portion thereof extending through interior panel 30 to second chamber 40 for measuring the air pressure within second chamber 40. Thus, if the operational mode of furnace 10 calls for heat and therefore the feeding of wood pellets from hopper 42 to combustion chamber 70 but the pressure measured within first chamber 40 is less than desired, programmable unit 114 will switch off auger motor 50 and auger 56.

To further describe the control system of furnace 10, an exemplary control system and the use thereof is described below.

Example

A control system utilizing a programmable logic controller (PLC) program unit, Model No. DL05 PLC unit from AutomationDirect was used. The PLC includes four discrete inputs including an on/off switch, a call for heat, a duct fan pressure switch and a blower fan pressure switch and six discrete outputs operatively coupled to blower fan 46, auger motor 50, duct fan 106, a red light, a yellow light and a green light. The PLC further includes three thermocouple inputs TC1, TC2, and TC3. TC1 is operatively coupled to first thermocouple 116, TC2 is operatively coupled to second thermocouple 118 and TC3 is operatively coupled to third thermocouple 120. Control system 114 further has three lights including a red light, a yellow light and a green light. A solid red light indicates an overtemp condition and a flashing red light indicates a failed duct fan pressure switch or a failed blower fan pressure switch. A solid yellow light indicates TC2 is below TC2 Standby as adjusted by TC3 and a flashing yellow light indicates that furnace 10 failed to heat within No Fire (min). A solid green light indicates that TC2 is above TC2 Standby as adjusted by TC3.

When the on/off switch is in the off position, all three lights are out. When the switch is turned to on, the green or yellow light activates depending on the current TC2 value. If TC2 is below TC2 Standby as adjusted by TC3, the yellow light activates. If TC2 is above TC2 Standby as adjusted by TC3, the green light activates. If TC2 rises above TC2 Overtemp as adjusted by TC3, the red light activates and the green light goes out. If duct fan 98 comes on and the duct fan pressure switch does not come on or if blower fan 46 comes on and the combustion fan pressure switch does not come on, a failed pressure switch is indicated by a flashing red light. If the system is not able to raise TC2 to above TC2 Standby as adjusted by TC3 within the No Fire (min) number of minutes, the failed to heat alarm is indicated by a flashing yellow light.

Set points are stored in non-volatile memory in control system 114. When the PLC first starts (after a power cycle or a program reset), memory location V7400 is checked within the PLC. If this location has a non-zero value (i.e. 1), then the PLC is assumed to already have operating values stored in the retentive flash ROM. If, however, location V7400 has a value of 0, it is then assumed the PLC retentive data has not yet been set. In this event, the application writes default set points to the retentive memory. This means upon the initial run of furnace 10 or a new PLC is started, the default set points will be written to the retentive memory. Once these values are written, they can be adjusted using DirectSoft5 or the operator touch panel. Thus, it is possible to have different furnaces running with different operating set points. This allows for flexibility to accommodate a wide range of applications and conditions. Set points can be changed by using a personal computer connected to the PLC while running DirectSoft5 or by use of the operator touch panel. Either of these allows changing of critical data.

The TC2 set points shown in FIG. 9 are not meant to imply that they are production values. These TC2 set points are only shown for demonstration purposes. Once TC2 set points production values are known, these are entered into the production version of the software and documented. The TC2 set points production values are determined based on the operational environment of each furnace 10 and are therefore subject to change.

All TC2 set points are adjusted by TC3 to adjust to varying ambient and incoming temperatures. In the event a fraction of TC3 is needed instead of all of TC3, a multiplier and divisor are used to adjust the amount of TC3 used in offsetting TC2. TC2 is adjusted by ((TC3*TC2 Adjust Mul)/TC2 Adjust Div). Thus, assuming TC2 Adjust Mul is 95 and TC2 Adjust Div is 100, if TC3 is currently at 74.5 F and TC2 Cool-down is 70.0, the actual set point will be 70.0+(74.5*95)/100=140.7. It is this adjusted value of 140.7 that is used in the application instead of the 70.0 set point.

All auger timers are entered in tenths of seconds. The on/off combinations all add up to 60 seconds though this not required. Any amount of on time and any amount of off time can be entered. The temperature settings are all shown in degrees Fahrenheit.

Set points Screen 1—Operational Modes

Set points Screen 1 is depicted in FIG. 9. Set points screen 1 is used to view and input the TC2 set points for the five operational modes of the control system. The operational modes include a TC2 Cool-down mode, a TC2 Standby mode, a TC2 CtrlRng Mn mode, a TC2 CtrlRng Mx mode and a TC2 Overheated mode. During TC2 Cool-down mode, when furnace 10 is heating up and still below the TC2 Cool-down set point as adjusted by TC3, the system uses the "Warm Auger On" and "Warm Auger Off" timers to add pellets to combustion chamber 70 so as not to smother the fire. When the on/off switch is turned to off, blower fan 46 remains on until TC2 drops below this value as adjusted by TC3. During TC2 Standby mode, when furnace 10 is on but there is no call for heat, the target temperature for TC2 is the standby temp as adjusted by TC3. If the current TC2 value is above TC2 Standby as adjusted by TC3, then the Over Auger On/Off timers are used for auger controls. If TC2 if below TC2 Standby as adjusted by TC3, the S-by Auger On/Off timers are used for auger controls. TC2 CtrlRng Mn and TC2 CtrlRng Mx are the minimum and maximum control range values. When TC2 is below TC2 CtrlRng Mn as adjusted by TC3, Ramp Auger On/Off settings are used to control auger 56. When TC2 is above TC2 CtrlRng Mn and below TC2 CtrlRng Mx as adjusted by TC3, the Ctrl Auger On/Off settings are used to control auger 56. When TC2 is above TC2 CtrlRng Mx and below TC2 Overheated as adjusted by TC3, the Over Auger On/Off settings are used to control the auger. In TC2 Overheated mode, when TC2 is above TC2 Overheated adjusted by TC3, auger 56 is off.

Set Points Screen 2—Combustion Blower Set Points Screen

Set points Screen 2 is depicted in FIG. 10. This screen allows for viewing and inputting combustion blower set points for use during the initial start up of furnace 10, i.e., during a build-up of fire within combustion chamber 70. The set points include Init Comb Cycs, Init Comb On, Init Comb Off and No Fire (min). The Init Comb Cycs set point determines the number of time the combustion fan is cycled to fan the flames. When the on/off switch is switched to on, the system will enter an initialization mode to carefully build up the beginning fire. When TC2 rises above TC2 Standby, the initial mode will be exited as the amount of heat is now sufficient. The Init Comb On set point determines the amount of time the combustion fan is on during each initial combustion fan cycle during the initialization mode. The Init Comb Off set point determines the amount of time the combustion fan is off during each initial combustion fan cycle during the initialization mode. The No Fire (min) set point determines the amount of time TC2 has to increase to above TC2 Standby as adjusted by TC3 before a failed to heat alarm is set.

Set Points Screen 3—Standby Auger Set Point Screen

Set points Screen 3 is depicted in FIG. 11. This screen allows for viewing and inputting standby auger set points. The S-by Auger On set point determines the amount of on time for auger 56 when in standby mode (no call for heat) and when TC2 is below TC2 Standby as adjusted by TC3. When TC2 is above TC2 Standby, Over Auger On will be used. The S-by Auger Off determines the amount of off time for auger 56 when in standby mode (no call for heat) and when TC2 is below TC2 Standby as adjusted by TC3. When TC2 is above TC2 Standby, Over Auger Off will be used. The Warm Auger On set point determines the amount of on time for auger 56 when there is a call for heat and TC2 is below TC2 Cool-down as adjusted by TC3. This slower auger feed rate is used to build the fire without smothering the fire. The Warm Auger Off setpoint determines the amount of off time for auger 56 when there is a call for heat and TC2 is below TC2 Cool-down as adjusted by TC3.

Set Points Screen 4—Ramp and Control Auger Set Point Screen

The Set points Screen 4 is depicted in FIG. 12. The screen allows for viewing and inputting of ramp and control auger set points. The Ramp Auger On set point determines the amount of auger on time when heating up and TC2 is above TC2 Cool-down and below TC2 CtrlRng Mn. The Ramp Auger Off set point determines the amount of auger off time when heating up and TC2 is above TC2 Cool-down and below TC2 CtrlRng Mn. The Ctrl Auger On set point determines the amount of auger on time when heating up and TC2 is above TC2 CtrlRng Mn and below TC2 CtrlRng Mx. The Ctrl Auger Off set point determines the amount of auger off time when heating up and TC2 is above TC2 CtrlRng Mn and below TC2 CtrlRng Mx.

Set Points Screen 5—Over Temperature Auger and Duct Blower Set Point Screen

The Set points Screen 5 is depicted in FIG. 13. This screen allowing viewing and inputting of over temperature auger and duct blower set points. The Over Auger On set point determines the amount of auger on time when TC2 is above TC2 Overtemp (and when in cool-down mode and TC2 is above TC2 Stadby). It is not suggested that auger 56 be left off totally. Thus, this set point should be some small value allowing occasional adding of pellets to the fire as the fire is cooled down. The Over Auger Off set point determines the amount of auger off time when TC2 is above TC2 Overtemp (and when in cool-down mode and TC2 is above TC2 Stadby). The TC1 Range Low set point turns off duct fan 98 when TC1 falls below TC1 Range Low. Duct fan 98 is controlled by TC1 and not adjusted by TC3 as is TC2. The TC1 Range High set point turns on duct fan 98 when TC1 rises above TCI Range High. To avoid fast cycling of duct fan 98, the duct fan will remain on for at least the Min Duct seconds. When TC1 rises above TC1 Range High, the fan will come on. Duct fan 98 will remain on for a minimum of Min Duct seconds. If after these seconds have elapsed and TC1 falls below TC1 Range Low, then the duct fan will be turned off.

As will be apparent to one skilled in the art, various modifications can be made within the scope of the aforesaid description. Such modifications being within the ability of one skilled in the art form a part of the present invention and are embraced by the claims below.

The invention claimed is:

1. A furnace comprising, a hopper having a first opening, a conveyor member arranged for conveying a fuel through the first opening, a first blower tube arranged for receiving the fuel from the hopper through the first opening, a first blower operatively coupled to the first blower tube and arranged for blowing the fuel through the first blower tube, a combustion chamber operatively coupled to the first blower tube opposite the first blower, a heat exchanger arranged above the combustion chamber, a second blower operatively coupled to a first compartment and arranged to blow a cooling air into the first compartment and through the heat exchanger, the first compartment at least partially surrounding the combustion chamber and the heat exchanger, a programmable control system operatively coupled to the conveyor member, the first blower, the second blower and a plurality of thermocouples, and a first pressure gauge for measuring the first compartment air pressure, the first pressure gauge being operatively coupled to the programmable control system and the programmable control system including auger off instructions configured for automatically inactivating the auger when the first compartment air pressure is less than desired.

2. The furnace according to claim 1 wherein the plurality of thermocouples include a first thermocouple arranged about an upper portion of an output side of the heat exchanger, a second thermocouple arranged about a lower portion of an output side of the heat exchanger and a third thermocouple arranged within the cooling air prior to it entering the first compartment.

3. The furnace according to claim 1 wherein the conveyor member is a single speed auger contained within a bottom of the hopper.

4. The furnace according to claim 1 wherein the first blower and the second blower are single speed blowers.

5. The furnace according to claim 1 further comprising a second blower tube operatively coupled between the first compartment and the second blower.

6. The furnace according to claim 1 wherein the plurality of thermocouples includes a second thermocouple positioned about a lower portion of an output side of the heat exchanger for measuring a second temperature of the cooling air exiting the heat exchanger.

7. The furnace according to claim 1 further comprising an interior wall separating the first compartment from a second chamber, wherein the second chamber supports the hopper and the first blower fan and the first blower tube extends through the interior wall.

8. The furnace according to claim 1 wherein the combustion chamber includes a removable combustion box and a port through the combustion chamber through which the combustion box can be removed.

9. A furnace comprising, a hopper having a first opening, a conveyor member arranged for conveying a fuel through the first opening, a first blower tube arranged for receiving the fuel from the hopper through the first opening, a first blower operatively coupled to the first blower tube and arranged for blowing the fuel through the first blower tube, a combustion chamber operatively coupled to the first blower tube opposite the first blower, a heat exchanger arranged above the combustion chamber, a second blower operatively coupled to a first compartment and arranged to blow a cooling air into the first compartment and through the heat exchanger, the first compartment at least partially surrounding the combustion chamber and the heat exchanger, and a programmable control system operatively coupled to the conveyor member, the first blower, the second blower and a plurality of thermocouples, wherein the plurality of thermocouples includes a first thermocouple positioned about an upper portion of an output side of the heat exchanger for measuring a first temperature of the cooling air exiting the heat exchanger and the programmable control system includes heat exchanger overheating instructions configured for automatically inactivating the conveyor member when the first temperature is greater than desired.

10. A furnace comprising, a hopper having a first opening, a conveyor member arranged for conveying a fuel through the first opening, a first blower tube arranged for receiving the fuel from the hopper through the first opening, a first blower operatively coupled to the first blower tube and arranged for blowing the fuel through the first blower tube, a combustion chamber operatively coupled to the first blower tube opposite the first blower, a heat exchanger arranged above the combustion chamber, a second blower operatively coupled to a first compartment and arranged to blow a cooling air into the first compartment and through the heat exchanger, the first compartment at least partially surrounding the combustion chamber and the heat exchanger, and a programmable control system operatively coupled to the conveyor member, the first blower, the second blower and a plurality of thermocouples, wherein the programmable control system includes a plurality of predetermined second temperature set points and a plurality of second temperature set point adjustment instructions configured for establishing adjusted second temperature set points based upon a third temperature of the cooling air before it enters the first compartment and the plurality of predetermined second temperature set points, and wherein the plurality of thermocouples includes a second thermocouple positioned about a lower portion of an output side of the heat exchanger for measuring a second temperature of the cooling air exiting the heat exchanger.

11. The furnace according to claim 10 wherein the programmable control system includes a plurality of auger control instructions configured for selecting a predetermined auger on to auger off ratio based upon the plurality of adjusted second temperature set points and the second temperature.

12. A furnace comprising, a hopper having a first opening, a conveyor member arranged for conveying a fuel through the first opening, a first blower tube arranged for receiving the fuel from the hopper through the first opening, a first blower operatively coupled to the first blower tube and arranged for blowing the fuel through the first blower tube, a combustion chamber operatively coupled to the first blower tube opposite the first blower, a heat exchanger arranged above the combustion chamber, a second blower operatively coupled to a first compartment and arranged to blow a cooling air into the first compartment and through the heat exchanger, the first compartment at least partially surrounding the combustion chamber and the heat exchanger, an interior wall separating the first compartment from a second chamber, wherein the second chamber supports the hopper and the first blower fan and the first blower tube extends through the interior wall, and a programmable control system operatively coupled to the conveyor member, the first blower, the second blower and a plurality of thermocouples, wherein the hopper is at least partially supported on a horizontal wall portion of the interior wall.

13. A furnace comprising, a hopper having a first opening, a conveyor member arranged for conveying a fuel through the first opening, a first blower tube arranged for receiving the fuel from the hopper through the first opening, a first blower operatively coupled to the first blower tube and arranged for blowing the fuel through the first blower tube, a combustion chamber operatively coupled to the first blower tube opposite the first blower, a heat exchanger arranged above the combustion chamber, a second blower operatively coupled to a first compartment and arranged to blow a cooling air into the first compartment and through the heat exchanger, the first compartment at least partially surrounding the combustion chamber and the heat exchanger, and a programmable control system operatively coupled to the conveyor member, the first blower, the second blower and a plurality of thermocouples, wherein the first blower tube includes a substantially horizontal portion having a second opening aligned directly underneath the first opening.

14. A furnace comprising, a hopper having a first opening, a conveyor member arranged for conveying a fuel through the first opening, a first blower tube arranged for receiving the fuel from the hopper through the first opening, a first blower operatively coupled to the first blower tube and arranged for blowing the fuel through the first blower tube, a combustion chamber operatively coupled to the first blower tube opposite the first blower, a heat exchanger arranged above the combustion chamber, a second blower operatively coupled to a first compartment and arranged to blow a cooling air into the first compartment and through the heat exchanger, the first compartment at least partially surrounding the combustion chamber and the heat exchanger, a programmable control system operatively coupled to the conveyor member, the first blower, the second blower and a plurality of thermocouples wherein the combustion chamber has an open top on which the heat exchanger is supported and the heat exchanger includes a bottom plate partially closing the open top of the combustion box and having a port there through operatively coupled to a cooling channel of the heat exchanger arranged to receive and cool heated air within the combustion chamber.

15. A method for manufacturing a furnace comprising, constructing an enclosure having a first compartment separated from a second compartment by an interior wall, providing a combustion air, solid fuel feed tube extending through the interior wall and between the first compartment and the second compartment, operatively coupling a first blower and a first input end of the first blower tube, operatively coupling a hopper and the combustion air, solid fuel feed tube, operatively coupling a fuel conveyor member and the hopper, supporting a combustion chamber within the second compartment and operatively coupling a first output end of the combustion air, solid fuel feed tube to the combustion chamber, supporting a heat exchanger in the second compartment and operatively coupling the heat exchanger to the combustion chamber, aligning an output hole in a bottom of the hopper with an input hole in the combustion air, solid fuel feed tube, operatively coupling a second blower and the second compartment, and operatively coupling a programmable control system to the first blower, the second blower and the fuel conveyor member.

16. The method according to claim 15 further comprising coupling a heat exchanger cooling channel and the combustion chamber.

17. The method according to claim 16 further comprising exposing an input side of the heat exchanger to an interior of the second compartment and an output side of the heat exchanger to outside of the second compartment.

18. The method according to claim 15 further comprising arranging the hopper within the first chamber.

19. The method according to claim 15 wherein the first blower and the second blower are supported by the first chamber.

20. The method according to claim 15 further comprising arranging a second thermocouple about a lower portion of an output side of the heat exchanger for obtaining a second temperature and a third thermocouple outside of the second compartment for obtaining a third temperature and operatively coupling the second thermocouple and the third thermocouple to the programmable control system.

21. The method according to claim 20 further comprising programming the programmable control system to include an operational mode for the furnace and a predetermined second temperature set point that is associated with the operational mode.

22. A method for manufacturing a furnace comprising, constructing an enclosure having a first compartment separated from a second compartment by an interior wall, providing a combustion air, solid fuel feed tube extending through the interior wall and between the first compartment and the second compartment, operatively coupling a first blower and a first input end of the first blower tube, operatively coupling a hopper and the combustion air, solid fuel feed tube, operatively coupling a fuel conveyor member and the hopper, supporting a combustion chamber within the second compartment and operatively coupling a first output end of the combustion air, solid fuel feed tube to the combustion chamber, supporting a heat exchanger in the second compartment and operatively coupling the heat exchanger to the combustion chamber, operatively coupling a second blower and the second compartment, operatively coupling a programmable control system to the first blower, the second blower and the fuel conveyor member, arranging a second thermocouple about a lower portion of an output side of the heat exchanger for obtaining a second temperature and a third thermocouple outside of the second compartment for obtaining a third temperature and operatively coupling the second thermocouple and the third thermocouple to the programmable control system, programming the programmable control system to include an operational mode for the furnace and a predetermined second temperature set point that is associated with the operational mode, and programming the programmable control system to calculate an adjusted second temperature set point based upon the third temperature.

23. The method according to claim 22 further comprising programming the programmable control system to include a set of predetermined auger control instructions associated with the operational mode wherein the set of predetermined auger control instructions modify a rate of supplying a solid fuel from the hopper to the first blower tube based upon the set of predetermined auger control instructions, the adjusted second temperature set point and the second temperature.

* * * * *